US007941946B2

(12) United States Patent
Clancy et al.

(10) Patent No.: US 7,941,946 B2
(45) Date of Patent: May 17, 2011

(54) ARTICLE OF FOOTWEAR FOR SAILING

(75) Inventors: James F. Clancy, Portland, OR (US); Sean M. McDowell, Portland, OR (US); Julia Roether, Portland, OR (US)

(73) Assignee: Nike, Inc., Beaverton, OR (US)

( * ) Notice: Subject to any disclaimer, the term of this patent is extended or adjusted under 35 U.S.C. 154(b) by 817 days.

(21) Appl. No.: 11/862,863

(22) Filed: Sep. 27, 2007

(65) Prior Publication Data

US 2009/0083996 A1 Apr. 2, 2009

(51) Int. Cl.

| | |
|---|---|
| ***A43B 5/08*** | (2006.01) |
| ***A43B 13/00*** | (2006.01) |
| ***A43B 3/00*** | (2006.01) |
| ***A43C 11/00*** | (2006.01) |

(52) U.S. Cl. ..... 36/113; 36/8.1; 36/58.5

(58) Field of Classification Search ..... 36/8.1, 36/4, 51, 58.5, 58.6, 72 R, 76 R, 7.3, 59 C, 36/103, 113

See application file for complete search history.

(56) References Cited

U.S. PATENT DOCUMENTS

| | | | | | |
|---|---|---|---|---|---|
| 987,054 | A | | 3/1911 | Eves | |
| 1,055,144 | A | | 3/1913 | Decius | |
| 1,184,013 | A | | 5/1916 | Pierce | |
| 1,637,027 | A | * | 7/1927 | Piper | 36/7.3 |
| 1,717,127 | A | * | 6/1929 | Toole | 36/4 |
| 2,079,237 | A | | 5/1937 | Allard | |
| D117,585 | S | * | 11/1939 | Sperry | D2/953 |
| 2,933,831 | A | * | 4/1960 | Le Compte | 36/4 |
| 3,191,321 | A | | 6/1965 | Brutting | |
| 3,470,630 | A | | 10/1969 | Wilmanns et al. | |
| 3,525,165 | A | | 8/1970 | Randall, Jr. | |
| 3,561,142 | A | | 2/1971 | Streit, Sr. et al. | |
| 3,650,051 | A | | 3/1972 | Sass | |
| 4,231,170 | A | | 11/1980 | Griswold | |
| 4,389,798 | A | | 6/1983 | Tilles | |
| 4,567,678 | A | | 2/1986 | Morgan et al. | |
| 4,649,656 | A | | 3/1987 | Cox et al. | |
| 4,707,874 | A | * | 11/1987 | Champagne | 12/142 E |
| 4,756,026 | A | | 7/1988 | Pierce, Jr. | |
| 4,793,075 | A | | 12/1988 | Thatcher | |
| 5,176,624 | A | | 1/1993 | Kuehnreich | |
| 5,205,071 | A | | 4/1993 | Hergenroeder | |
| D336,765 | S | | 6/1993 | Cohen | |
| 5,245,767 | A | * | 9/1993 | Morin | 36/136 |
| 5,699,629 | A | | 12/1997 | Munschy | |
| 5,711,092 | A | | 1/1998 | Despres et al. | |
| 5,778,565 | A | | 7/1998 | Holt et al. | |
| 5,878,512 | A | * | 3/1999 | Cooper et al. | 36/84 |

(Continued)

FOREIGN PATENT DOCUMENTS

WO WO 2006/050565 5/2006

OTHER PUBLICATIONS

Office Action mailed Jul. 7, 2010 in U.S. Appl. No. 11/862,874.
Office Action mailed Jul. 8, 2010 in U.S. Appl. No. 11/862,885.

*Primary Examiner* — Jila M Mohandesi
(74) *Attorney, Agent, or Firm* — Plumsea Law Group, LLC

(57) ABSTRACT

An article of footwear for water sports disclosed. The article may be worn by a helmsman on a sailboat. The article may include provisions to facilitate increased traction and support for a foot of the helmsman.

20 Claims, 9 Drawing Sheets

U.S. PATENT DOCUMENTS

| | | | | |
|---|---|---|---|---|
| 5,913,592 | A | 6/1999 | Moore | |
| D412,780 | S | 8/1999 | Hatfield et al. | |
| D414,317 | S | 9/1999 | Lubart | |
| 5,950,333 | A * | 9/1999 | Tsen | 36/7.1 R |
| D415,610 | S | 10/1999 | Cahill | |
| D417,943 | S | 12/1999 | Solaroli | |
| D431,351 | S | 10/2000 | Prats et al. | |
| 6,170,174 | B1 | 1/2001 | Gesso | |
| 6,183,377 | B1 * | 2/2001 | Liang | 473/324 |
| 6,381,876 | B2 | 5/2002 | Krajcir | |
| 6,389,715 | B1 | 5/2002 | Krajcir | |
| 6,427,363 | B1 | 8/2002 | Hunter | |
| 6,523,282 | B1 | 2/2003 | Johnston | |
| D473,042 | S | 4/2003 | Wilson | |
| D476,141 | S | 6/2003 | Matis | |
| D512,826 | S | 12/2005 | Hatfield | |
| D520,723 | S | 5/2006 | Hoeft | |
| D523,624 | S | 6/2006 | Kuerbis | |
| 7,069,670 | B1 * | 7/2006 | Gerke | 36/2 R |
| 7,316,082 | B2 | 1/2008 | Hernandez Martinez-Portillo et al. | |
| 7,475,501 | B1 | 1/2009 | DeToro et al. | |
| 2003/0196354 | A1 | 10/2003 | Chu | |
| 2004/0175064 | A1 * | 9/2004 | Damour | 384/294 |
| 2006/0101669 | A1 | 5/2006 | Santos | |
| 2006/0143944 | A1 | 7/2006 | Collins | |
| 2008/0098626 | A1 | 5/2008 | Wright | |

* cited by examiner

ARTICLE OF FOOTWEAR FOR SAILING

BACKGROUND OF THE INVENTION

1. Field of the Invention

The present invention relates generally to footwear and in particular to an article of footwear configured for sailing.

2. Description of Related Art

Articles of footwear for water sports have been previously proposed. Moore (U.S. Pat. No. 5,913,592) teaches a performance water boot. The Moore design includes a water boot having an adjustable strap that crosses an upper between the instep region and the collar region of the boot. Moore teaches a heel cup that is designed to cooperate with the adjustable strap in order to seal off the heel and ankle regions of the upper. Moore teaches this arrangement to prevent water from entering the instep region and causing the foot to move within the boot.

Collins (U.S. patent number 2006/0143944) teaches an article of footwear designed for surfing. The Collins design includes a thin rubber outsole that wraps underneath the forefoot. Collins further teaches a tread disposed on the bottom of the outsole. However, the Collins design does not include a heel portion, but instead the heel and rear of the article of footwear is left open to expose the rear and heel of a foot. The Collins design lacks support for the rear of the foot and the heel. Additionally, while Collins teaches a strap for fastening the article of footwear, it is a single strap wrapping around the ankle and in particular no straps are provided for fastening the forefoot.

Hergenroeder (U.S. Pat. No. 5,205,071) teaches a surfing sandal. The sandal includes an instep strap configured to extend across the instep at the top of the foot. According to Hergenroeder, the instep strap may function as an instep pad. Hergenroeder further teaches a traction surface with traction pads adapted to extend across the bottom of the foot between the heel and the ball of the foot. Hergenroeder teaches materials for the sandal including neoprene and materials for the traction pads including rubber.

Conolly (WO patent number 2006/050565) teaches a water sport hiking system. The Conolly design includes a device that provides support for sailors while hiking from a sailing vessel. Conolly teaches a water sport boot constructed primarily of neoprene and rubber. The water sport boot includes a top support panel made of rubber that extends from the top of the toe to the top of the boot. Conolly also teaches a toe support panel that is distinct from the top support panel and covers the toe.

Krajcir (U.S. Pat. No. 6,381,876) teaches a metatarsal protector for footwear. Krajcir teaches a metatarsal protector that consists of a body molded from resilient plastics material to facilitate walking and kneeling. Krajcir also teaches a separate toe box protector. The metatarsal protector extends from the end of the toe box protector.

SUMMARY OF THE INVENTION

An article of footwear configured for sailing is disclosed. In one aspect, the invention provides an article of footwear configured to provide traction on a wet surface, comprising: a water durable upper and a slip-resistant sole; a support member associated with the upper, the support member extending from a toe portion of the upper to a front ankle portion of the upper; and where the support member is substantially rigid.

In another aspect, the support member is made of a substantially rigid rubber.

In another aspect, a bottom portion of the sole includes a herringbone pattern.

In another aspect, the upper is fastened on a side of the upper.

In another aspect, an upper cover is configured to cover a substantial majority of the upper.

In another aspect, the support member is disposed over the upper cover.

In another aspect, the invention provides an article of footwear configured to provide traction on a wet surface, comprising: a water durable upper and a slip-resistant sole; a substantially rigid support member associated with the upper and configured to protect a foot disposed within the upper; and where an upper cover is disposed between the upper and the support member.

In another aspect, the support member is made of a substantially rigid rubber.

In another aspect, the upper cover prevents the support member from contacting the upper.

In another aspect, the upper cover is configured to cover a toe portion, an instep portion and a front ankle portion of an upper.

In another aspect, the upper cover is configured to cover a substantial majority of the upper.

In another aspect, the support member is fixedly attached to the upper cover.

In another aspect, the support member and the upper cover are coincident at a front portion of the upper.

In another aspect, the invention provides an article of footwear configured to provide traction on a wet surface, comprising: a water durable upper and a slip-resistant sole; an upper cover configured to cover a toe portion, an instep portion and a front ankle portion of an upper; a support member extending from a toe portion of the upper to a front ankle portion of the upper; and where the upper cover is configured to cover a substantial majority of the upper and wherein the support member is configured to attach to the upper cover.

In another aspect, a front side of the upper includes front gripping members.

In another aspect, a rear side of the upper includes rear gripping members.

In another aspect, the front gripping members are configured to engage a portion of a boat.

In another aspect, the rear gripping members are configured to engage a portion of a boat.

In another aspect, the front gripping members are disposed on the support member.

In another aspect, the rear gripping members are disposed on the sole.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
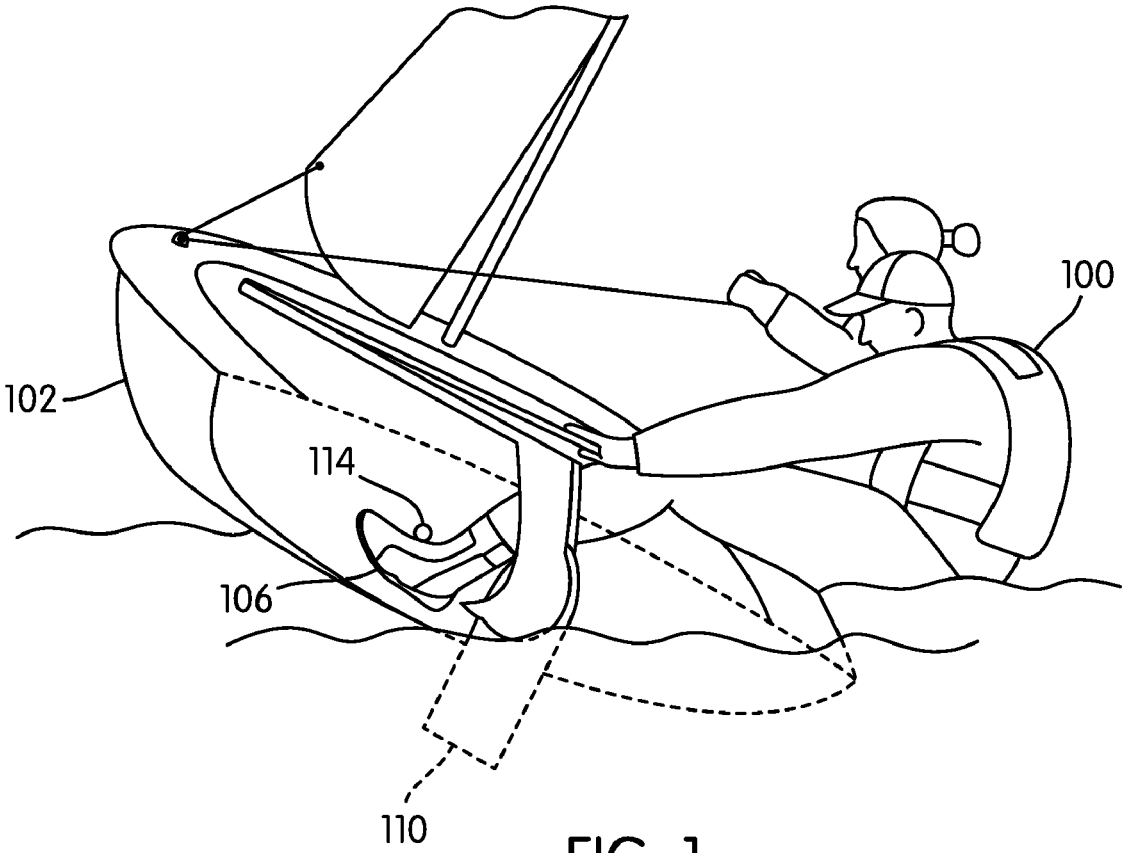
FIG. 1 is a preferred embodiment of a helmsman steering a boat.

FIG. 1 is a preferred embodiment of helmsman 100 steering boat 102. The term 'helmsman' as used throughout this detailed specification and in the claims refers to anyone capable of operating boat 102. The term helmsman is not meant to be restricted to professional sailors, amateur sailors or any other type of competitors. In some embodiments, helmsman 100 may not be competing in any sport or activity.

In a preferred embodiment, boat 102 is a sailboat. In some embodiments, helmsman 100 may steer boat 102 by steering rudder 110. As illustrated in FIG. 1, helmsman 100 may have to lean on edge 112 of boat 102 during some sailing maneuvers. In some embodiments, boat 102 may include provisions to help to steady helmsman 100 and help helmsman 100 retain his or her position within boat 102. In a preferred embodiment, boat 102 may include cross bar 114. Helmsman 100 may insert one or both feet under cross bar 114 to help with stability.

Figure 2:
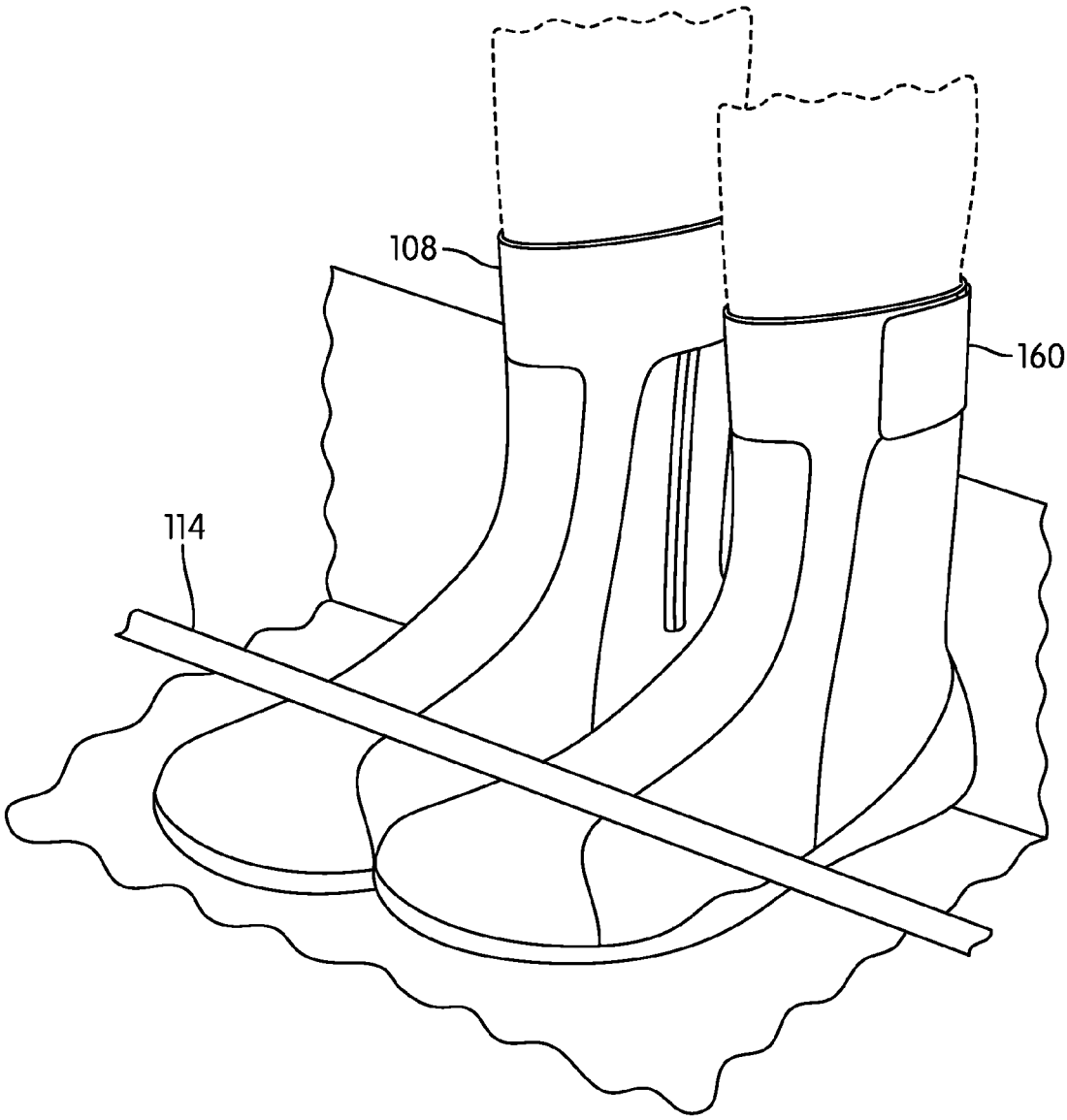
FIG. 2 is an isometric view of a preferred embodiment of a helmsman wearing an article of footwear and a complementary article of footwear.

Referring to FIG. 2, helmsman 100 is preferably wearing article of footwear 106 and complementary article of footwear 108. Preferably, to achieve stability, articles of footwear 106 and 108 may be planted beneath cross bar 114. Using this configuration, helmsman 100 may move in any direction as they steer rudder 110 without the risk of falling out of boat 102.

Figure 3:
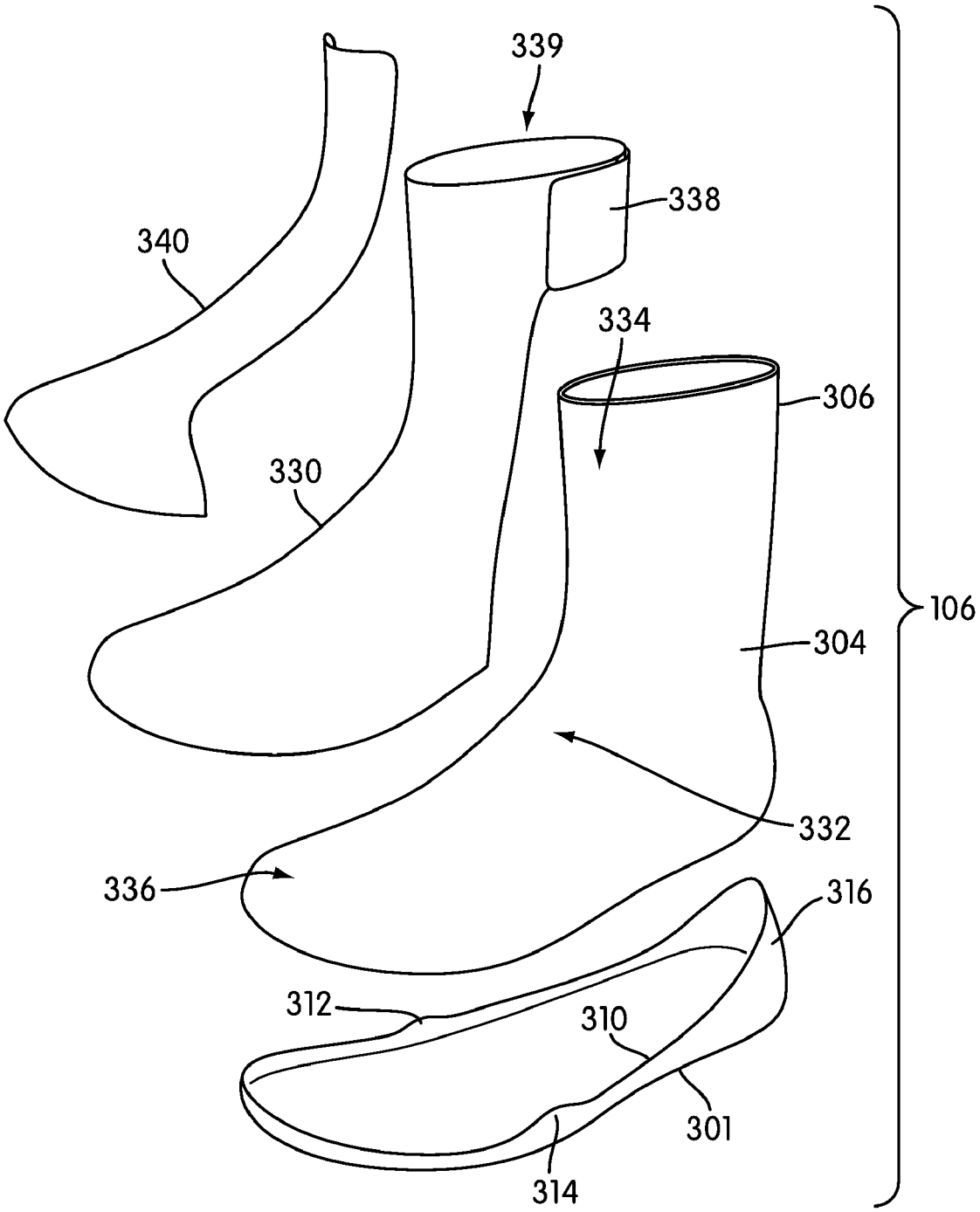
FIG. 3 is an exploded isometric view of a preferred embodiment of an article of footwear.

FIG. 3 is an exploded isometric view of a preferred embodiment of article of footwear 106. The following detailed description discusses characteristics of article of footwear 106. It should be understood, however, that these same characteristics apply to complementary article of footwear 108.

In this preferred embodiment, article of footwear 106 is a sailing shoe. In other embodiments, article of footwear 106 could be another kind of shoe used for similar activities. In particular, the features of article of footwear 106 that are useful for sailing may be equally applicable and useful in similar water sports or other types of activities. In other words, the following features of article of footwear 106 are not meant to be restricted to sailing or boating shoes.

Article of footwear 106 preferably includes upper 304. In some embodiments, upper 304 may be made of a soft and flexible material. Examples of such materials include elastic materials and any type of water proof materials. In a preferred embodiment, upper 304 is made of neoprene or a similar material. Using this preferred material, upper 304 may be configured to provide insulation for a foot during use. More generally, upper 304 may be made of a water durable material. The term 'water durable' is used throughout this detailed specification and in the claims to refer to any material that is not affected by extended exposure to water. This is important because article of footwear 106 may get wet many times during windsurfing or similar water activities.

By using a flexible material, upper 304 may conform to a foot in order to prevent excessive water from seeping through ankle collar 306. In some embodiments, ankle collar 306 may include an additional elastic lining configured to close tightly around the foot of helmsman 100. Although water may be absorbed through upper 304 during use, excessive water may be prevented from building up because of the conforming nature of upper 304, which may help prevent slipping or chaffing of upper 304 due a build up of excess water.

Preferably, article of footwear 106 includes sole 301. In this embodiment, sole 301 may be a wrap-around sole. The term 'wrap-around sole' is used throughout the remainder of this detailed description and in the claims to refer to any sole including a periphery that extends vertically around the sides of upper 304.

In this embodiment, sole 301 includes side wall periphery 310. In some embodiments, side wall periphery 310 may further include medial extended portion 312 and lateral extended portion 314. Generally, portions 312 and 314 may be constructed as flaps that extend further beyond side wall periphery 310. In some embodiments, portions 312 and 314 may be attached directly to upper 304. In other embodiments, portions 312 and 314 may not attach directly to upper 304, but may flap instead with respect to sole 301.

Sole 301 may be further associated with heel member 316. Preferably, heel member 316 may be continuously formed with sole 301. In some embodiments, heel member 316 may be configured to attach directly to upper 304. Generally, heel member 316 may be made of any durable material including various kinds of rubber. In some cases, heel member 316 may act as a heel counter. This arrangement preferably provides additional protection at the heel of article of footwear 106.

Preferably, sole 301 is made of a water resistant or waterproof material. In some embodiments, sole 301 may be made of a material configured to facilitate increased traction. In some embodiments, sole 301 may be made of a substantially flexible material. In a preferred embodiment, sole 301 may be made of some type of rubber, including various elastomers.

In addition to sole 301 and upper 304, article of footwear 106 preferably includes upper cover 330. In some embodiments, upper cover 330 may be configured to cover instep portion 332 of upper 304. In other embodiments, upper cover 330 may be configured to cover front ankle portion 334 of upper 304. In still other embodiments, upper cover 330 may be configured to cover toe portion 336 of upper 304. In a preferred embodiment, upper cover 330 may be configured to cover a substantial majority of upper 304, including portions 332, 334 and 336 of upper 304 simultaneously.

In some embodiments, upper cover 330 may be attached directly to upper 304. In other embodiments, upper cover 330 may be configured to attach to sole 301. In a preferred embodiment, upper cover 330 may be configured to attach to both upper 304 and sole 301, simultaneously. Generally, upper cover 330 may be fastened to either sole 301 or upper 304 using an adhesive or other method of attachment.

Upper cover 330 may be made of any semi-durable material. Preferably, upper cover 330 may be made of a material that is configured to partially deform. Examples of suitable materials include, but are not limited to, elastomers, siloxanes, natural rubber, other synthetic rubbers, natural leather, synthetic leather, or plastics. In a preferred embodiment, upper cover 330 may be made of a semi-durable rubber or plastic.

Upper cover 330 may be further associated with strap 338. Preferably, strap 338 is disposed at top portion 339 of upper cover 330. In some embodiments, strap 338 may be continuously formed with upper cover 330. In a preferred embodiment, strap 338 may be configured to wrap around ankle collar 306 of upper 304 when article of footwear 106 is assembled. A detailed discussion of the fastening of article of footwear 106 using strap 338 is discussed later in this detailed description.

Preferably, article of footwear 106 includes provisions for protecting a foot of helmsman 100. In some embodiments, article of footwear 106 may include generally rigid, non-deforming member configured to protect the instep of the foot, especially against the pressure of cross bar 114 during the operation of boat 102. In some embodiments, article of footwear 106 may also include provisions for protecting the toes of the foot. In some embodiments, article of footwear 106 may also include provisions for protecting the front of the ankle.

In some embodiments, upper 304 may be associated with support member 340. In a preferred embodiment, support member 340 may be disposed over upper cover 330. In other words, upper cover 330 may be disposed between upper 304 and support member 340. Using this arrangement, support member 340 is prevented from contacting upper 304 at any portion. Preferably, support member 340 extends from toe portion 336 to front ankle portion 334 of upper 304. In other words, support member 340 is configured to cover portions 332, 334 and 336 of upper 304.

Preferably, support member 340 comprises a single piece of material that is configured to conform to upper cover 330. In some embodiments, support member 340 may be narrower than upper cover 330, especially at central portion 341 that is associated with instep portion 332 of upper 304 and at upper portion 343 that is associated with front ankle portion 334. In a preferred embodiment, front portion 345 may be configured to substantially cover a majority of toe portion 336 of upper 304 and the associated portions of upper cover 330. In some cases, front portion 345 of support member 340 may be coincident with upper cover 330 adjacent to toe portion 336.

Generally, support member 340 may be made of substantially rigid material. Preferably, support member 340 may be made of a material that does not substantially deform. Examples of suitable materials include, but are not limited to various types of rigid elastomers, siloxanes, rubbers, or plastics. In a preferred embodiment, support member 340 may be made of a rigid rubber that does not substantially deform.

This single piece design of a substantially rigid support member preferably allows for increased protection of portions 332, 334 and 336 of upper 304 and the associated parts of the foot. In particular, using a single piece of material that is conformed to the shape of upper 304 helps to prevent pressure points that may result from creases or regions that are unprotected. Instead, the current design provides for any weight being applied to support member 340 to be distributed equally over portions 332, 334 and 336 of upper 304.

FIGS. 4-10 are intended to further illustrate preferred embodiments of various provisions associated with the different components associated with a preferred embodiment. In particular, provisions associated with sole 301 and strap 338 and support member 340 are discussed in further detail.

Preferably, article of footwear 106 includes slip-resistant provisions. In some embodiments, article of footwear 106 may include a sole configured to provide extra traction in wet conditions. In a preferred embodiment, the sole may include provisions for channeling water away from article of footwear 106 in order to increase traction.

Figure 4:
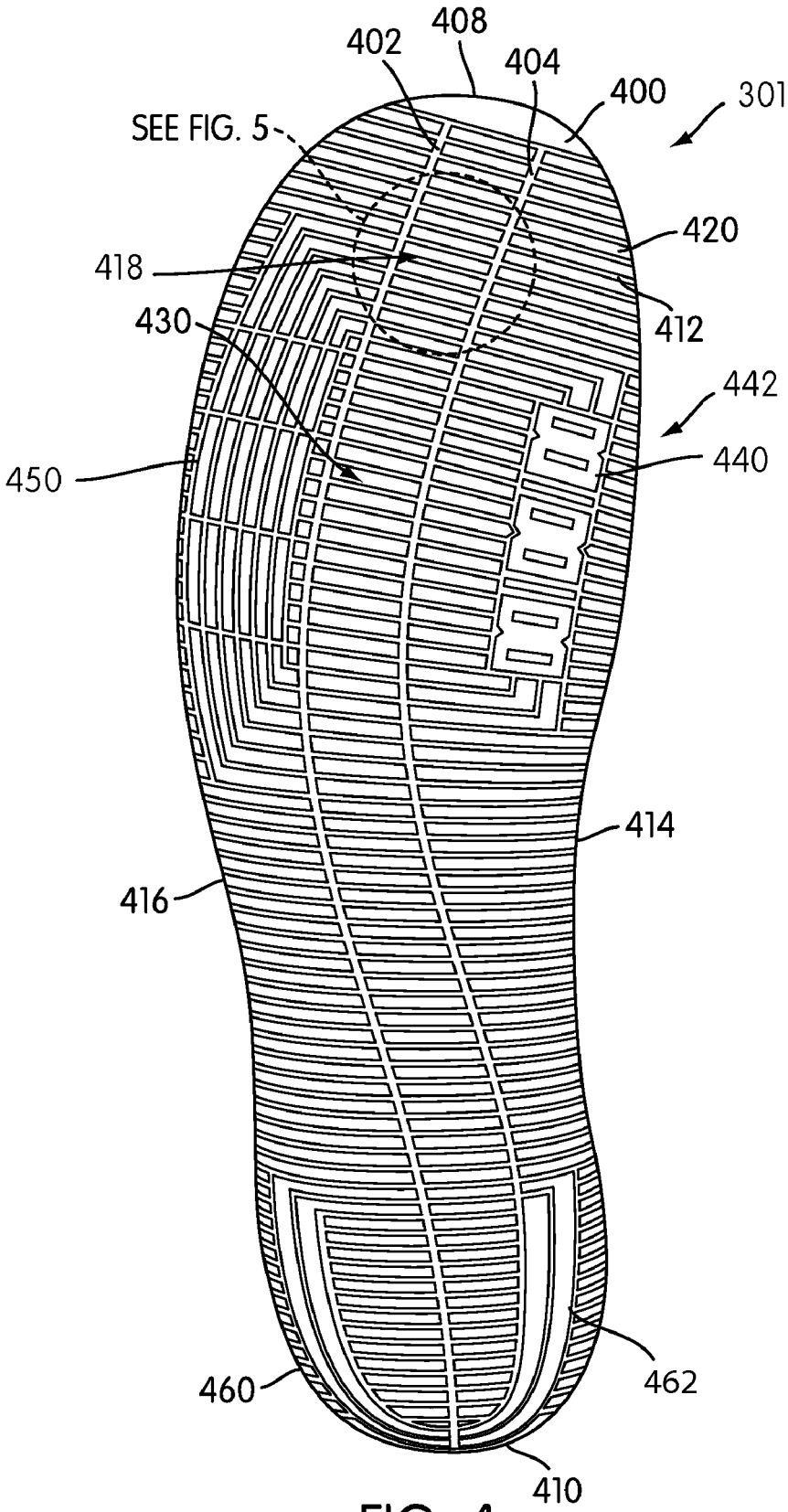
FIG. 4 is a preferred embodiment of a bottom portion of a sole of an article of footwear.

FIG. 4 is an exemplary embodiment of bottom portion 400 of sole 301. Preferably, bottom portion 400 includes first central channel 402 and second central channel 404. In some embodiments, first central channel 402 and second central channel 404 may have grooves disposed in bottom portion 400. Preferably, channels 402 and 404 extend from forward end 408 to rear end 410 of bottom portion 400.

In some embodiments, bottom portion 400 may also include lateral channels 412. Preferably, lateral channels 412 extend from medial side 414 to lateral side 416 of bottom portion 400. In this preferred embodiment, lateral channels 412 may intersect central channels 402 and 404. In this embodiment, lateral channels 412 are generally perpendicular to central channels 402 and 404, however in other embodiments, lateral channels 412 could be disposed at any angle with respect to central channels 402 and 404.

Figure 5:
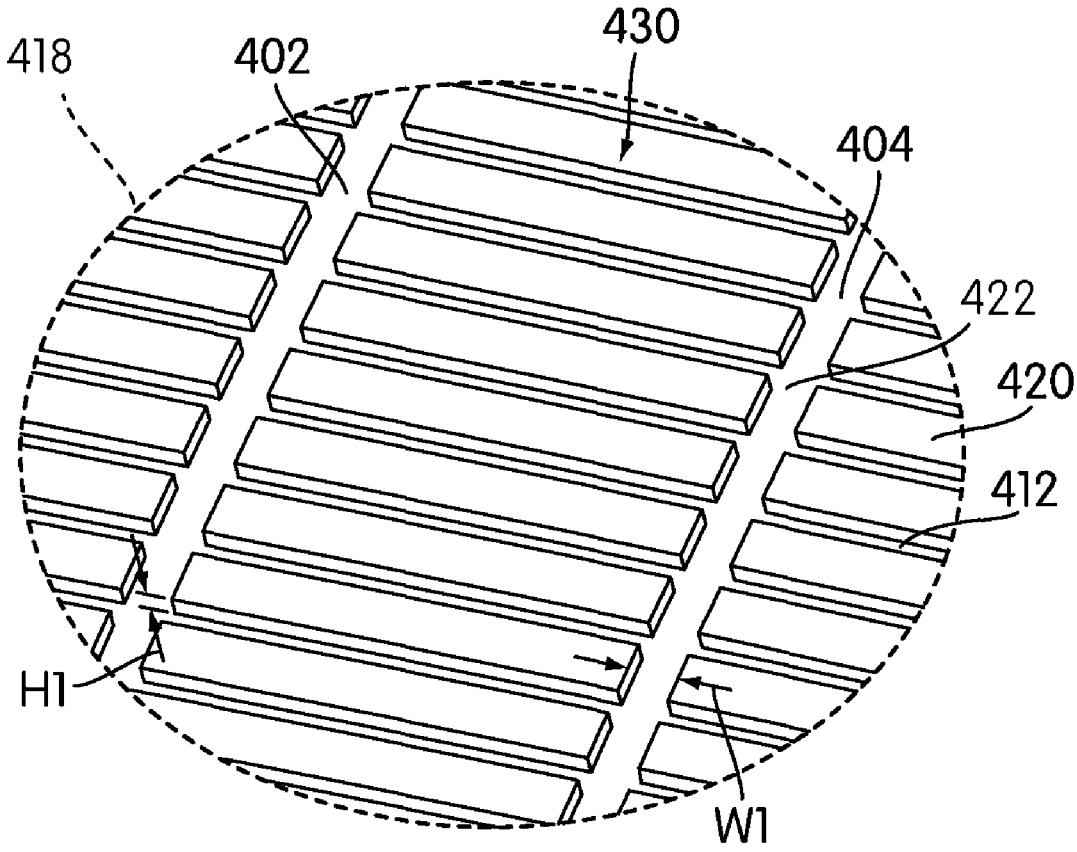
FIG. 5 is a close up view of a preferred embodiment of a portion of a bottom portion of a sole of an article of footwear.

Referring to FIG. 5, a close up of a preferred embodiment of first portion 418 of bottom portion 400, channels 402, 404 and 412 form grooves in sole 301. In some embodiments, tread elements 420 may be disposed between channels 402, 404 and 412. In a preferred embodiment, tread elements 420 extend a height H1 above base surface 422. In some embodiments, height H1 may range from 0.1 millimeters to 5 millimeters. In a preferred embodiment, height H1 has a value of 1 millimeter.

Generally, the widths of channels 402, 404 and 412 may vary. In this embodiment, second central channel 404 has a width W1. Preferably, the widths of channels 402 and 412 are substantially similar to width W1 of second central channel 404. The value of width W1 may vary between 0.1 millimeters and 2 millimeters. In a preferred embodiment, width W1 has a value of 1 millimeter.

Referring to FIGS. 4-5, central channels 402 and 404 define a central contact region 430. In particular, central contact region 430 includes the region between central channels 402 and 404. Preferably, central contact region 430 is configured to engage a surface first. If the surface is wet, water is preferably channeled away from central contact region 430 via channels 402, 404 and 412. In a preferred embodiment, water moves longitudinally through central channels 402 and 404 and laterally outwards through lateral channels 412. Using this preferred configuration, as water is generally directed out from under bottom portion 400, tread elements 420 may more easily contact the surface. This arrangement helps prevent slipping due to losses in friction caused by water disposed between tread elements 420 and the surface.

In some embodiments, sole 301 may include additional provisions for increasing traction on wet surfaces. In this preferred embodiment, bottom portion 400 also includes large recesses 440 disposed at ball region 442. Typically, a majority of weight is put on the ball of the foot. Therefore, as a wearer steps down, excess water contacting ball region 442 may be pumped away with greater efficiency through large recesses 440.

In some embodiments, bottom portion 400 may also include additional curved channels. In this preferred embodiment, bottom portion 400 may include curved channels 450. In some cases, curved channels 450 may provide additional traction during pivoting, as bottom portion 400 may rotate about ball region 442. In other embodiments, curved channels 450 may provide additional longitudinal channels for the water to move along, thus increasing the distribution to lateral channels 412.

In some embodiments, bottom portion 400 may also include provisions for increasing traction at heel region 460. To provide increased traction as the heel is lowered, heel region 460 may include U-shaped channels 462. These channels preferably facilitate the pumping of water away from heel region 460, especially at central contact region 430.

It should be understood that large recesses 440, curved channels 450 and U-shaped channels 462 are optional. In other embodiments, only some of these provisions may be incorporated into bottom portion 400. In still other embodiments, none of these additional provisions may be used. Generally, by including some of these additional provisions, the type of traction achieved may be modified. Additionally, varying height H1 associated with tread elements 420 and width W1 associated with channels 402, 404 and 412, the amount of traction may also be varied.

Using these provisions associated with sole 301, article of footwear 106 may be configured to provide increased traction on a wet surface. This feature is especially important for articles of footwear used in various sports such as sailing, canoeing, kayaking and similar water sports. As helmsman 100 steps on boat 102, rocks or other wet surfaces, sole 301 may facilitate reduced slipping.

This arrangement for sole 301 is only intended to be exemplary. In another embodiment, sole 301 could include a different type of tread pattern. Generally, any type of tread pattern known in the art may be applied to sole 301 to provide increased traction. In a preferred embodiment, sole 301 may include a herringbone type tread pattern.

Figure 11:
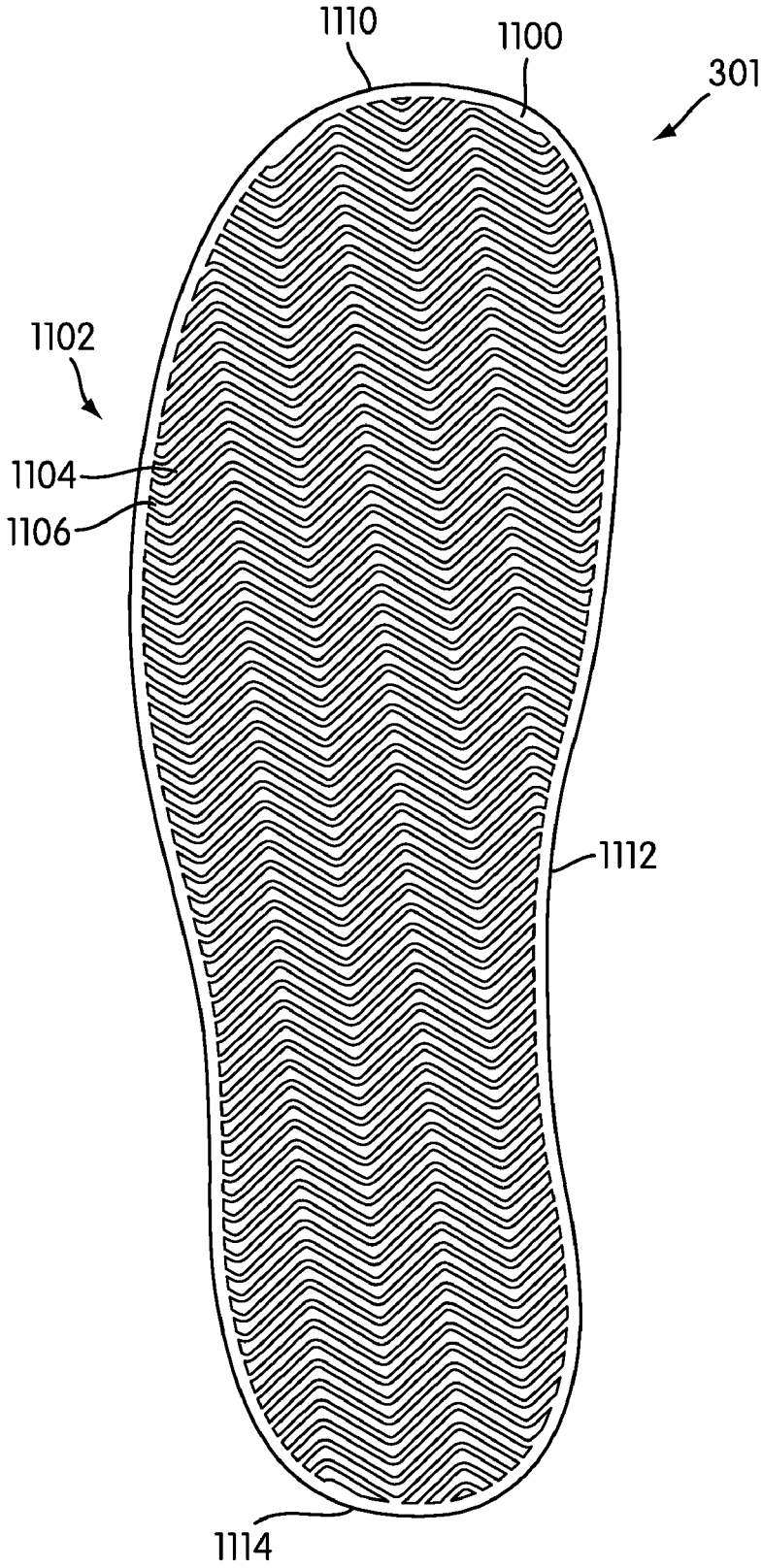
FIG. 11 is a preferred embodiment of a bottom portion of a sole of an article of footwear.

FIG. 11 is a preferred embodiment of bottom portion 1100 of sole 301. In some embodiments, bottom portion 1100 includes tread pattern 1102. In this preferred embodiment, tread pattern 1102 is a herringbone pattern. Preferably, tread pattern 1102 may include ridges 1104 and channels 1106. Ridges 1104 and channels 1106 may be configured in wave like arrangements. This arrangement allows for increased traction with a surface by channeling water through channels 1106.

In the embodiment shown in FIG. 11, tread pattern 1102 is applied to the entirety of bottom portion 1100. However, in other embodiments, tread pattern 1102 may be applied to only a portion of bottom portion 1100. For example, tread pattern 1102 could be applied to front portion 1110, middle portion 1112, rear portion 1114 as well as any combination of these portions. Additionally, in other embodiments, bottom portion 1100 could include additional structural features as well, including any of the structural features discussed and illustrated in FIGS. 4 and 5.

Preferably, article of footwear 106 includes provisions for easily fastening upper 304 and sole 301 to a foot. In some embodiments, article of footwear 106 includes some kind of fastening straps. In a preferred embodiment, article of footwear 106 may include additional fastening provisions.

Figure 6:
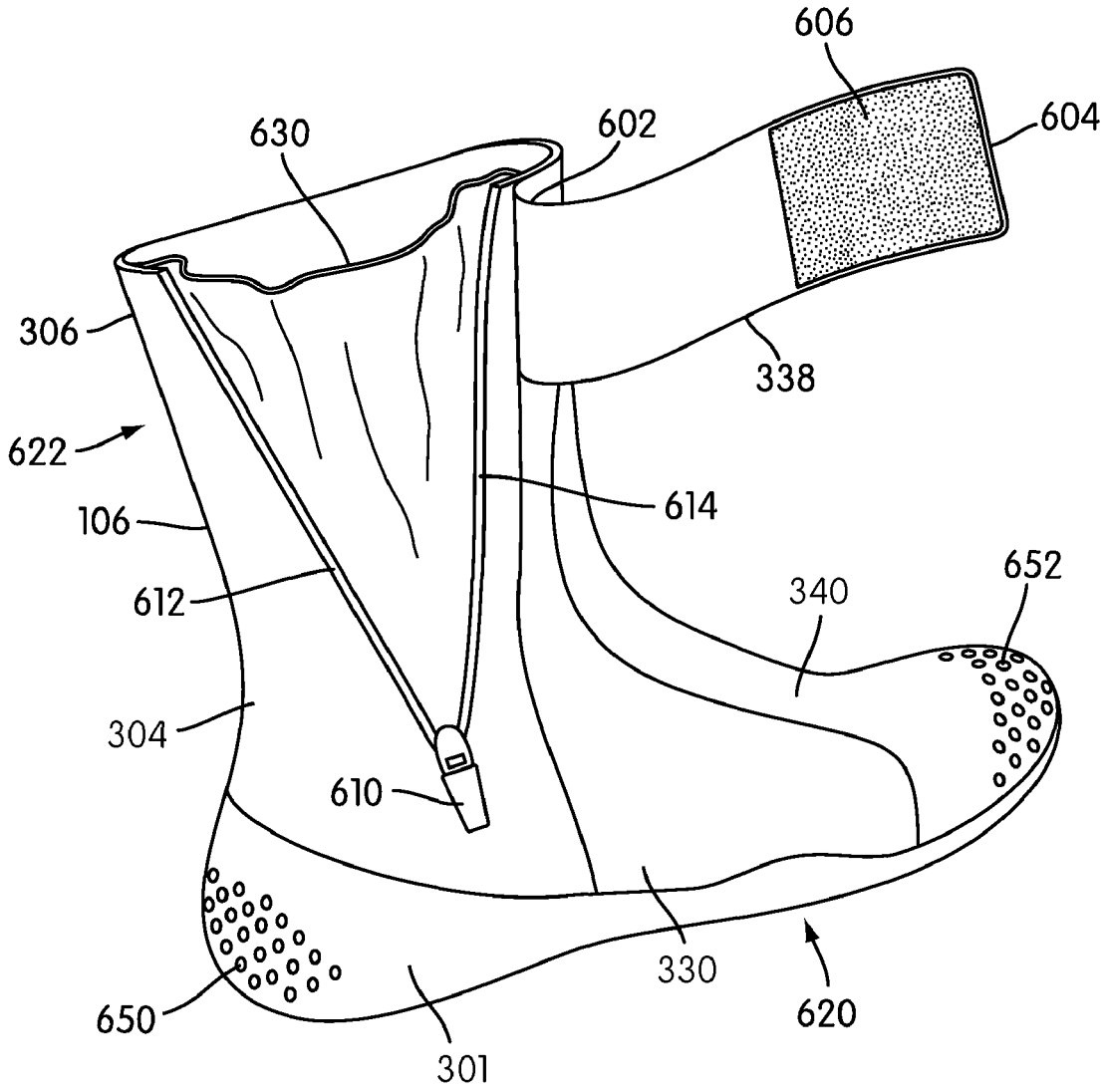
FIG. 6 is an isometric view of a preferred embodiment of an article of footwear unfastened.

As previously discussed, article of footwear 106 includes strap 338. Referring to FIG. 6, strap 338 preferably includes fixed portion 602. In this embodiment, fixed portion 602 is fixedly attached to upper 304 at ankle collar 306. Strap 338 also preferably includes free portion 604. Preferably, free portion 604 includes first fastening region 606. In some embodiments, first fastening region 606 comprises one side of a hook and loop fastener, such as Velcro®.

Article of footwear 106 may also include secondary fastener 610. In a preferred embodiment, secondary fastener 610 is a zipper. In other embodiments, secondary fastener 610 could be another type of fastener including lacing. In still other embodiments, secondary fastener 610 could be a hook and loop fastener, such as Velcro®.

In this embodiment, secondary fastener 610 is configured to fasten on medial side 620 of article of footwear 106. In this embodiment, secondary fastener 610 is configured to fasten first edge 612 with second edge 614 of upper 304. Generally, secondary fastener 610 may be configured to close at ankle collar 306. Using this preferred configuration, secondary fastener 610 may be configured to tighten upper 304, especially at ankle collar 306.

Preferably, secondary fastener 610 may be further associated with extendable portion 630 of upper 304. Preferably, extendable portion 630 is made of an expanding material such as neoprene or similar types of materials. In this embodiment, when secondary fastener 610 is in an unfastened position (as seen in FIG. 6), extendable portion 630 may open to allow helmsman 100 to more easily slip their foot into article of footwear 106. Later, as secondary fastener 610 is fastened, extendable portion 630 may contract around the foot as upper 304 is tightened.

Figure 7:
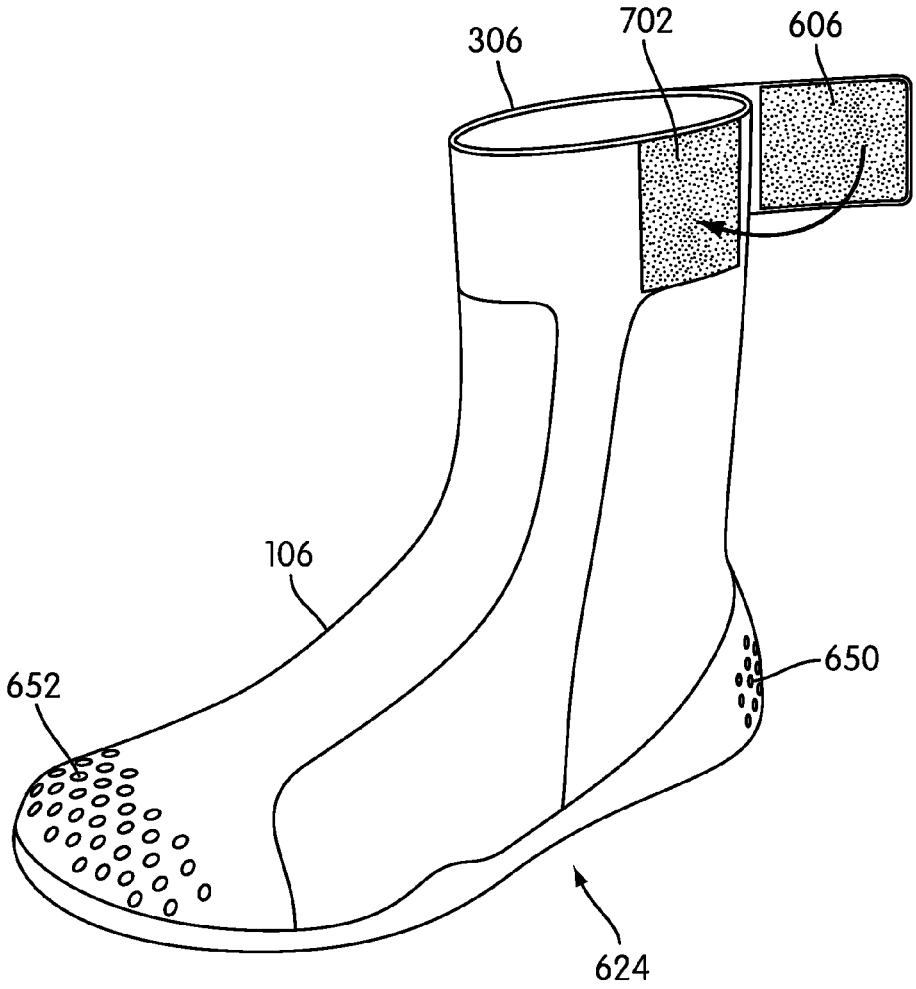
FIG. 7 is an isometric view of a preferred embodiment of an article of footwear partially fastened.

Referring to FIGS. 6 and 7, the fastening of article of footwear 106 preferably begins by closing secondary fastener 610. In this embodiment, secondary fastener 610 may be 'zipped' up to ankle collar 306. Then, strap 338 may be wrapped around medial side 620, rear side 622 and finally lateral side 624, as seen in FIG. 7. As strap 338 wraps around medial side 620, strap 338 may cover secondary fastener 610. This preferred arrangement may prevent secondary fastener 610 from accidentally coming unfastened or 'unzipped' during use.

Preferably, lateral side 624 includes second fastening region 702. In this embodiment, second fastening region 702 is disposed on ankle collar 306. As free portion 604 of strap 338 extends around to lateral side 624, first fastening region 606 preferably engages second fastening region 702. In a preferred embodiment, fastening regions 606 and 702 may be complementary sides of a hook and loop fastener, such as Velcro®. Using this preferred arrangement, ankle collar 306 of upper 304 may be tightened around a foot using strap 338. This arrangement may help decrease the tendency of large amounts of water to splash into upper 304 and cause irritation or other problems to helmsman 100.

Referring to FIGS. 6 and 7, article of footwear 106 may include provisions for increasing traction at the front and rear sides of upper 304. In this embodiment, a front side of article of upper 304 may be associated with front gripping members 652. Likewise, a rear side of upper 304 may include rear gripping members 650. Front gripping members 652 and rear gripping members 650 may be optional in some embodiments. In a preferred embodiment, article of footwear 106 may include both front gripping members 652 and rear gripping members 650.

In this embodiment, front gripping members 652 may be attached to support member 340. Also, rear gripping members 650 may be attached to sole 301. In other embodiments, one or more sets of gripping members could be disposed on upper cover 330 as well.

Generally, gripping members 650 and 652 may be made of any material. Preferably, gripping members 650 and 652 are made of a material such as rubber that helps to increase traction. Additionally, gripping members 650 and 652 may have any shape. In this preferred embodiment, gripping members 650 and 652 have hemispherical shape. With this preferred arrangement, gripping members 650 and 652 may be used to increase traction between article of footwear 106 and various components of boat 106 (see FIG. 1). In some cases, gripping members 650 and 652 may provide increased traction with cross bar 114 and another surface of boat 106.

In this preferred embodiment, upper 304 may be attached directly to sole 301 in order to prevent water from entering upper 304. In other embodiments, however, article of footwear 106 may include provisions to increase air flow through upper 304, especially at toe portion 336. This arrangement may also allow some water to enter upper 304.

Figure 8:
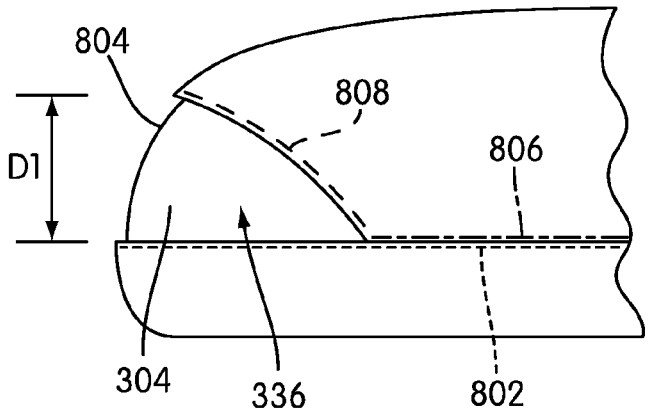
FIG. 8 is a side view of a preferred embodiment of a front portion of an article of footwear.

FIG. 8 is a side view of an alternative embodiment of front portion 800 of article of footwear 106. Generally, support member 340 is configured to attach to sole 301 at second periphery 802. In some embodiments, support member 340 may not attach to the entirety of second periphery 802. In a preferred embodiment, support member 340 is configured to allow front tip 804 of upper 304 to be exposed.

In this alternative embodiment, support member 340 includes first periphery 806. In some embodiments, first periphery 806 includes peripheral portion 808. In this embodiment, peripheral portion 808 is preferably spaced from second periphery 802. In a preferred embodiment, peripheral portion 808 is preferably spaced a distance D1 from second periphery 802. With this preferred arrangement, front tip 804 of upper 304 may be exposed, allowing increased airflow in and out of upper 304 at toe portion 336.

The current embodiment discusses the orientation of support member 340 with respect to sole 301. However, it should be understood that a similar discussion applied to upper cover 330. In particular, upper cover 330 and support member 340 may be coincident at front portion 800 of article of footwear 106, so that upper cover 330 includes a periphery that is coincident with first periphery 806 of support member 340.

As previously discussed and illustrated in FIG. 2, helmsman 100 may need to plant one or more articles of footwear beneath cross bar 114 to maintain balance while steering boat 102. Preferably, an article of footwear is configured to facilitate associating a foot with 114 during sailing.

Figure 9:
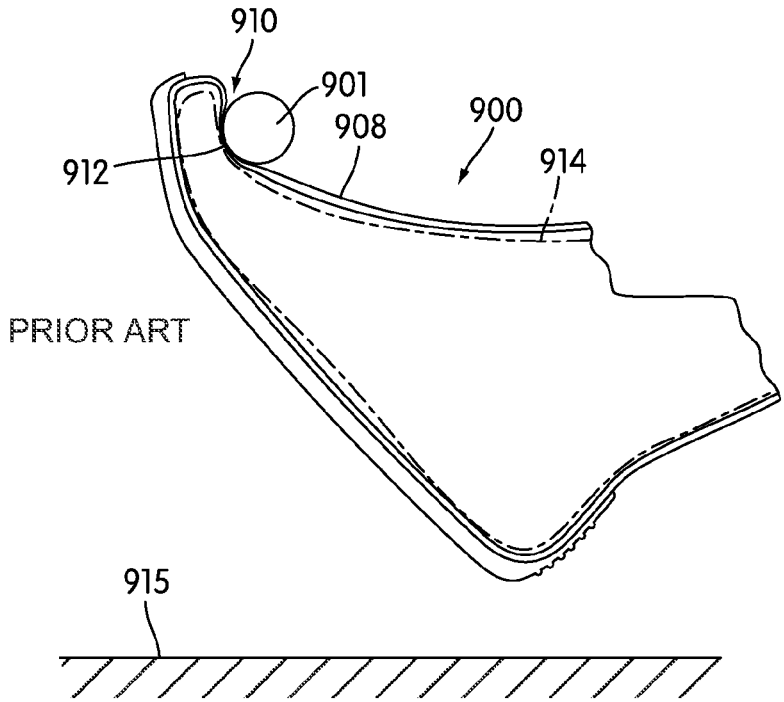
FIG. 9 is a side view of an exemplary embodiment of an article of footwear with a cross bar.

Referring to FIG. 9, prior designs for articles of footwear for sailors have not included provisions to increase traction of an article of footwear with cross bar 901 as well as increased support for the helmsman. In this exemplary embodiment of a prior design, article of footwear 900 is wedged between cross bar 901 and wall 915 of a boat. In this embodiment, as the helmsman leans back, cross bar 901 applies increasing pressure to upper 908 of article of footwear 900. In this case, upper 908 is not made of a substantially rigid material and therefore, upper 908 partially deforms at first portion 910. This configuration generally results in increased pressure applied directly to first region 912 of foot 914.

With this prior design, foot 914 and article of footwear 900 may hyper extend under increased pressure on the toes of foot 914 to retain a position under cross bar 901. This arrangement may make it difficult to maintain contact at wall 915. Additionally, article of footwear 900 does not include any traction increasing provisions as are provided in the preferred design discussed previously. This arrangement could result in slipping between article of footwear 900 and cross bar 901 and wall 915 of the boat. Eventually this may lead to slipping that may result in helmsman 100 losing his or her balance.

Figure 10:
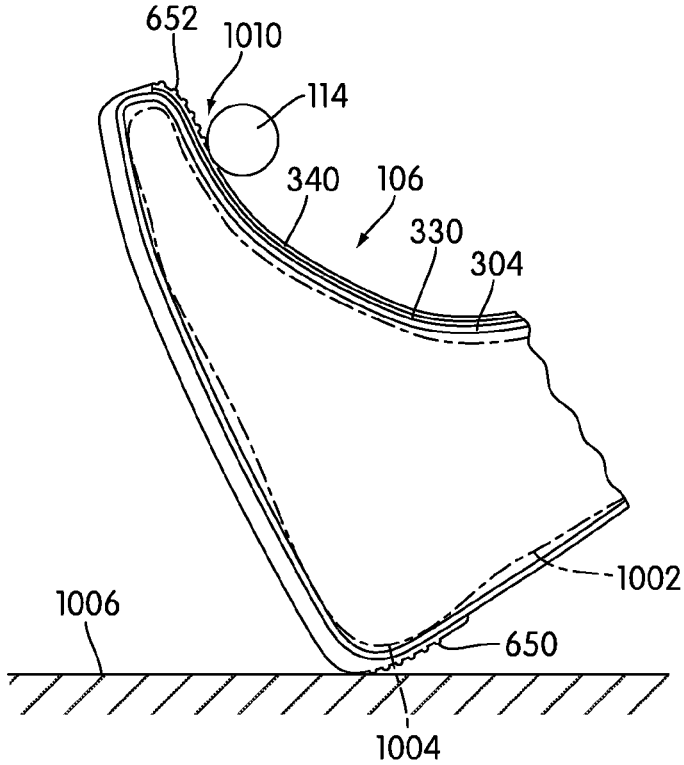
FIG. 10 is a side view of a preferred embodiment of an article of footwear with a cross bar.

FIG. 10 is intended to illustrate a preferred embodiment of the current design. In this embodiment, article of footwear 106 preferably includes support member 340. In this case, as helmsman 100 leans back, cross bar 114 is pressed against support member 340 at first portion 1010. Because support member 340 is made of a substantially rigid material, support member 340 does not deflect or bend. In particular, the force applied to support member 340 by cross bar 114 is evenly distributed over upper 304 and in some cases, the majority of this pressure is distributed to sole 301 via the connection between support member 340 and sole 301. This preferred arrangement generally increases support to the helmsman.

It should be understood that the positioning of cross bar 114 with respect to article of footwear 106 is only intended to be exemplary. In other embodiments, cross bar 114 may be disposed against another portion of support member 340. Generally, anywhere cross bar 114 may contact support member 340 will be non-deforming. Furthermore, heel member 316 generally provides increased protection for heel 1004 of foot 1002 as article of footwear 106 is pressed back against wall 1006. This arrangement helps to increase traction and provide additional support for the helmsman.

Generally, sole 301, heel member 316 and support member 340 may form a rigid system. This rigid system may help to prevent the type of hyper extension that occurs in some prior designs. Using this preferred configuration, article of footwear 106 may be configured to maintain a fixed position with respect to cross bar 114 and wall 1006. This configuration may help to keep helmsman 100 steady during the operation of boat 102.

As previously discussed, article of footwear 106 also includes gripping members 650 and 652 configured to provide increased traction. Preferably, front gripping members 652 may be disposed against cross bar 114. Likewise, rear gripping members 650 may be disposed against wall 1006. Using gripping members 650 and 652, article of footwear 106 may be prevented from slipping with respect to cross bar 114 and wall 1006. This preferred configuration may help helmsman 100 maintain stability and stay within boat 102.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear configured to provide traction on a wet surface, comprising:

a water durable upper comprising an elastic, flexible material and configured to conform to a wearer's foot;

a slip-resistant sole;

an upper cover configured to cover a substantial majority of the upper;

a support member permanently attached to an external surface of the upper cover;

a fastener disposed at an ankle region of the upper cover and configured to secure the upper and the upper cover in a conforming manner at the ankle region of the wearer's foot, wherein the fastener secures the upper, the upper cover and the support member to the ankle region of the wearer's foot;

wherein the support member extends from a toe portion of the upper to a front ankle portion of the upper and conforms to the shape of the upper; and wherein the support member is substantially rigid.

2. The article of footwear according to claim 1, wherein the support member is made of a substantially rigid rubber.

3. The article of footwear according to claim 1, wherein a bottom portion of the sole includes a herringbone pattern.

4. The article of footwear according to claim 1, further comprising a secondary fastener disposed on a side of the upper.

5. The article of footwear according to claim 1, wherein the support member includes front gripping members.

6. The article of footwear according to claim 5, wherein a side of the upper comprises a secondary fastener and the upper cover fastener is configured to cover a portion of the secondary fastener.

7. An article of footwear configured to provide traction on a wet surface, comprising:

a water durable upper comprising an elastic, flexible material and a slip-resistant sole;

a substantially rigid support member disposed on an upper cover, wherein the support member extends from a toe portion of the upper cover to a front ankle portion of the upper cover and is configured to protect a foot disposed within the upper;

a fastener disposed at an ankle region of the upper cover and configured to secure the upper and the upper cover in a conforming manner at the ankle region of the wearer's foot;

wherein the rigid support member conforms to the shape of the upper and upper cover;

wherein the upper cover is disposed between the upper and the support member and the rigid support member is permanently attached to an external surface of the upper cover.

8. The article of footwear according to claim 7, wherein the support member is made of a substantially rigid rubber.

9. The article of footwear according to claim 7, wherein the upper cover prevents the support member from contacting the upper.

10. The article of footwear according to claim 7, wherein the upper cover is configured to cover a toe portion, an instep portion and a front ankle portion of an upper.

11. The article of footwear according to claim 10, wherein the upper cover is configured to cover a substantial majority of the upper.

12. The article of footwear according to claim 11, wherein the sole comprises a wrap-around sole.

13. The article of footwear according to claim 12, wherein the support member and the upper cover are coincident at a front portion of the upper.

14. An article of footwear configured to provide traction on a wet surface, comprising:

a water durable upper comprising an elastic, flexible material and a slip-resistant sole;

an upper cover configured to cover a toe portion, an instep portion and a front ankle portion of an upper;

a support member extending from a toe portion of the upper to a front ankle portion of the upper; and wherein the upper cover is configured to cover a substantial majority of the upper and wherein the support member is configured to attach to the upper cover; and wherein the support member includes front gripping members configured to protrude out from the support member.

15. The article of footwear according to claim 14, wherein a rear side of the upper includes rear gripping members.

16. The article of footwear according to claim 14, wherein the front gripping members are configured to engage a portion of a boat.

17. The article of footwear according to claim 15, wherein the rear gripping members are configured to engage a portion of a boat.

18. The article of footwear according to claim 15, wherein the rear gripping members are disposed on the sole.

19. The article of footwear according to claim 14, further comprising an upper cover fastener disposed at an ankle region of the upper cover and configured to secure the upper and the upper cover to the wearer's foot.

20. The article of footwear according to claim 19, wherein a side of the upper comprises a secondary fastener and the upper cover fastener is configured to cover a portion of the secondary fastener.

* * * * *